US006979145B2

(12) United States Patent
Kozlowski

(10) Patent No.: US 6,979,145 B2
(45) Date of Patent: Dec. 27, 2005

(54) DRIVEWAY GUTTER HAVING FLEXIBLE FILLER MAT

(76) Inventor: Michael Kozlowski, 401 Pleasant Ave., North Syracuse, NY (US) 13212

( * ) Notice: Subject to any disclaimer, the term of this patent is extended or adjusted under 35 U.S.C. 154(b) by 0 days.

(21) Appl. No.: 11/179,328

(22) Filed: Jul. 12, 2005

(65) Prior Publication Data

US 2005/0241241 A1 Nov. 3, 2005

Related U.S. Application Data

(63) Continuation-in-part of application No. 10/630,653, filed on Jul. 30, 2003.

(51) Int. Cl.[7] ..... E01F 9/00

(52) U.S. Cl. ..... 404/10; 404/15; 404/73; 14/69.5

(58) Field of Search ..... 404/2, 3, 7, 9, 404/10, 15, 73; 14/69.5

(56) References Cited

U.S. PATENT DOCUMENTS

| | | | | |
|---|---|---|---|---|
| 134,994 | A | 1/1873 | Linson | 404/7 |
| 398,630 | A | 2/1889 | Landis | 404/7 |
| 2,021,759 | A | 11/1935 | White | 40/615 |
| 3,037,433 | A | 6/1962 | Maher | 404/7 |
| 3,053,156 | A | 9/1962 | Jennings, Jr. | 404/98 |
| 3,223,006 | A | 12/1965 | Jones et al. | 404/98 |
| 3,680,319 | A | 8/1972 | Draper et al. | 405/116 |
| 3,957,383 | A | 5/1976 | Fredericks | 404/8 |
| 4,068,968 | A | 1/1978 | Gagle et al. | 404/7 |
| 4,199,541 | A | 4/1980 | McFarland | 264/34 |
| 4,575,278 | A | 3/1986 | Whitney | 404/72 |
| 4,813,811 | A | 3/1989 | Adams | 404/15 |
| 5,242,493 | A | 9/1993 | Glynn et al. | 106/277 |
| 5,306,105 | A * | 4/1994 | Langbrandner et al. | 404/12 |
| 5,364,206 | A * | 11/1994 | Marienfeld | 405/16 |
| 5,415,493 | A | 5/1995 | Eaton | 404/15 |
| 6,175,103 | B1 | 1/2001 | Lam et al. | 219/506 |
| 6,309,137 | B1 | 10/2001 | Hirsch | 404/15 |
| 6,457,901 | B1 | 10/2002 | Sondrup | 404/26 |
| 6,675,422 | B1 | 1/2004 | Kukendall | 14/69.5 |
| 6,688,805 | B1 | 2/2004 | Kochling | 404/7 |

FOREIGN PATENT DOCUMENTS

| | | | |
|---|---|---|---|
| CA | 2140505 | 1/1995 | E01C 1/02 |

* cited by examiner

*Primary Examiner*—Gary S. Hartmann
(74) *Attorney, Agent, or Firm*—Brown & Michaels, PC

(57) ABSTRACT

An improved driveway gutter having a flexible gutter mat bridging the trough in the gutter for improving driving over driveway gutters. The mat is made of flexible material such as heavy rubber. The mat is placed with its flat bottom bridging the gutter, and fastened down by bolts in recessed holes in the mat. Because the mat is flexible, when a car drives over the mat it is forced down to conform with the gutter, and the top of the mat smoothes out the gutter for the car. When the weight is removed the mat springs back into shape bridging the gutter, so that the passage of water is not impeded. The fastening holes are deep enough that the fasteners do not protrude above the surface of the mat when it is deformed by a tire crossing the mat.

6 Claims, 2 Drawing Sheets

Fig. 4
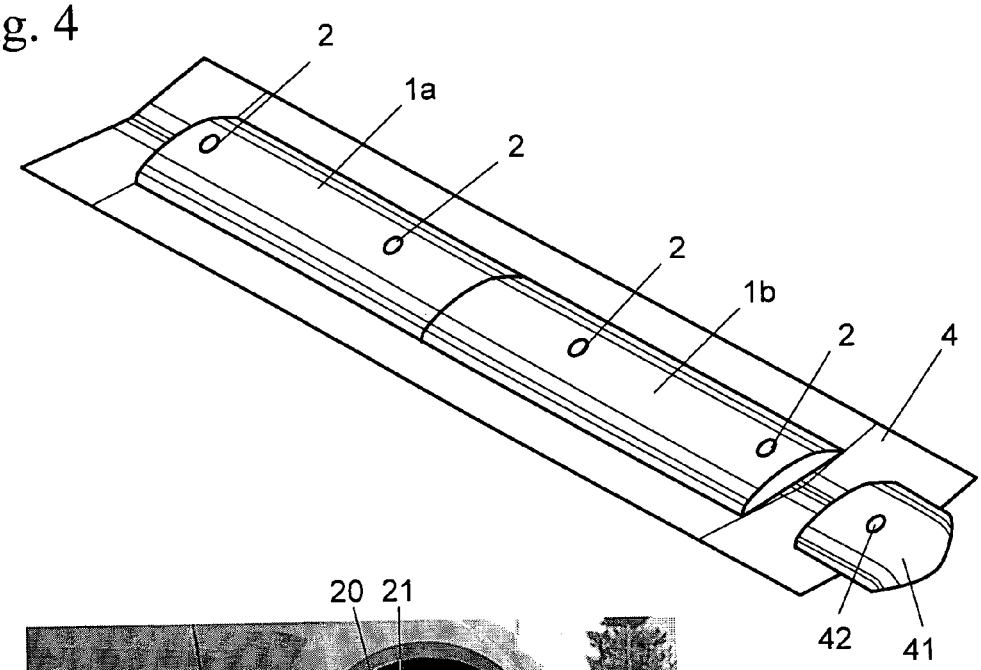
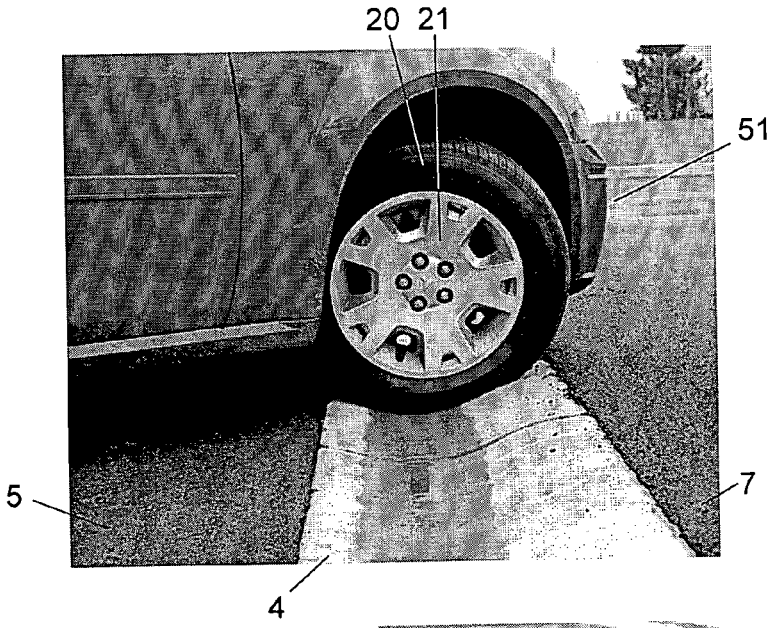
Fig. 5
Prior Art
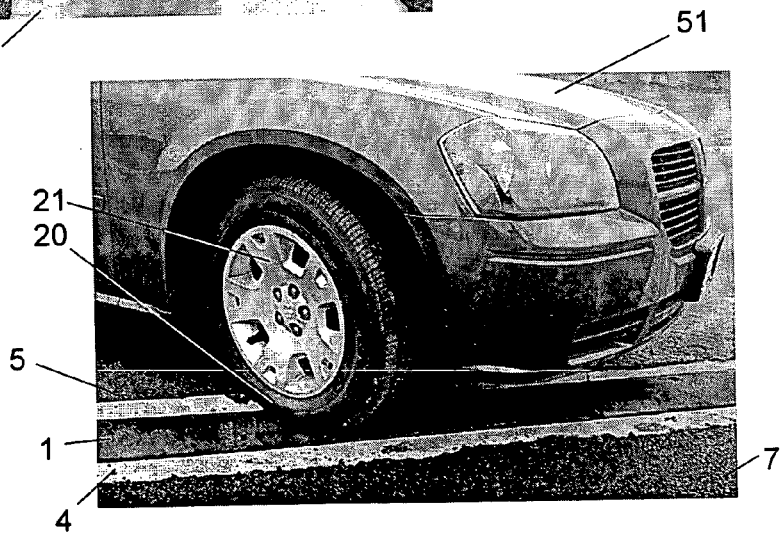
Fig. 6

DRIVEWAY GUTTER HAVING FLEXIBLE FILLER MAT

REFERENCE TO RELATED APPLICATIONS

This is a continuation-in-part patent application of copending application Ser. No. 10/630,653, filed Jul. 30, 2003, entitled "APPARATUS AND METHOD FOR DRIVEWAY GUTTER". The aforementioned application is hereby incorporated herein by reference.

BACKGROUND OF THE INVENTION

1. Field of the Invention

The invention pertains to the field of roadside gutters. More particularly, the invention pertains to improving driving conditions for crossing driveway gutters through the use of flexible filler mats.

2. Description of Related Art

Referring to the cross-section of FIG. 1 and the picture of FIG. 5, a driveway typically slopes downward from a parking area or garage, through a cut in the curb, down to a street. The driveway usually has a layer of asphalt (7) over layers of binder (8), stone (9) and compacted sub-base soil (10). The street usually has a surface layer (5) of asphalt or concrete over a sub-base (6).

In many cases a gutter (4), usually prefabricated of concrete, separates the driveway surface (7) and the road surface (5). The gutter has a depressed surface (16) which serves to guide water down the roadside to storm sewers, drywells or drains or the like.

The typical driveway gutter (4) presents a problem for drivers, frequently causing drivers to slow down upon approaching the transition between the roadway and the driveway, and often causing undue bumping of the vehicle upon entering or exiting the driveway, because of the gutter. FIG. 5 shows a picture of a car (51), with its front tire (20) dropping down into the gutter (4) between roadway (5) and driveway (7).

In particular, where the gutter (4) is made of concrete, which is very hard, and the driveway surface (7) is asphalt, which is relatively soft, this difference in material strength results in damage to the driveway, due to undue wear from vehicles entering the driveway, bumping the gutter (4) and subsequently pounding on the driveway pavement (7).

Temporary ramps are known, for bridging between a road surface and a curb. Kuykendall, U.S. Pat. No. 6,675,422, shows such a ramp. Curbs are not gutters—gutters are horizontal, with a depressed surface for rainwater, curbs extend upward vertically, or possibly at a steep angle as shown in Kuykendall's figures. Ramps for bridging curbs must of necessity be rigid, or they would simply collapse and not perform their function as a ramp. Kuykendall's ramp is made of rigid material (ABS plastic), with a flat planar upper surface having raised treads, and a rigid support member extending down to the curb from the lower surface of the ramp. The support member holds the ramp up, so that the ramp is always supported rigidly in place while leaning against the steep curb.

Also known are various configurations of speed bumps, either integral with or permanently or reversibly affixed to the roadway, which commonly are used as a physical obstruction to encourage drivers to proceed slowly, such as in parking lots or other areas with high pedestrian traffic. Such speed bumps are sometimes prefabricated of heavy rubber with a flat bottom and a domed top.

SUMMARY OF THE INVENTION

The present invention is an improved driveway gutter having a flexible gutter mat bridging the trough in the gutter for improving driving over driveway gutters.

The mat preferably comprises one or more sections of pre-fabricated speed bump made of flexible material such as heavy rubber. The mat is placed so that the flat bottom bridges the gutter, and the mat may be fastened down by bolts in recessed holes in the mat. Because the mat is flexible, when a car drives over the mat it is forced down to conform with the gutter, and the top of the mat smoothes out the gutter for the car. When the weight is removed the mat springs back into shape bridging the gutter, so that the passage of water is not impeded.

BRIEF DESCRIPTION OF THE DRAWING

FIG. 4 shows a perspective view of the flexible mat of the invention in a gutter, in a form made up of several separate sections.

FIG. 5 shows a picture of a car tire in a gutter, as in the prior art.

FIG. 6 shows a picture of a car tire in a gutter having the flexible mat of the invention

DETAILED DESCRIPTION OF THE INVENTION

Figure 1:
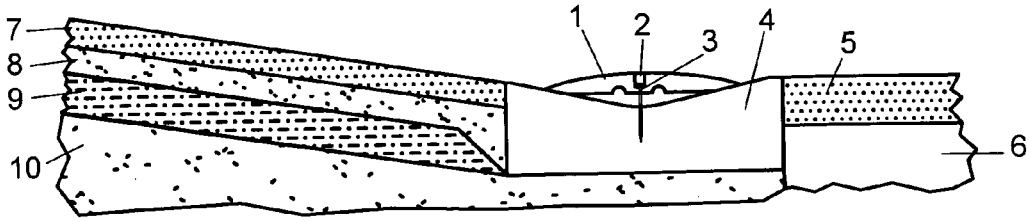
FIG. 1 shows a cross-section diagram of the end of a driveway, having the flexible mat of the invention in a gutter
Figure 2:
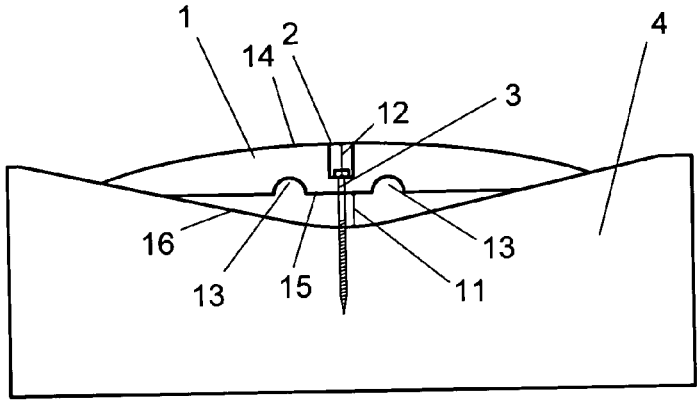
FIG. 2 shows a gutter having the flexible mat of the invention therein.

Referring to FIGS. 1 and 2, the invention comprises a flexible gutter mat, preferably in the form of one or more sections of prefabricated speed bump (1). Rubber speed bumps are preferred because they are extremely durable; they will not rot, chip, or corrode and are UV-resistant. They typically are made from solid, rugged, recycled rubber tires and are built to withstand in excess of 2,500 psi of pressure.

The mat preferably has a domed top (14) and flat bottom (15), and is sufficiently rigid to bridge the bottom (16) of the gutter (4), allowing free passage of water. For a typical gutter (4), the height of the bridging (11) is about 2" (50 mm). Many prefabricated speed bumps have channels (13) on their lower surface (15). These are not required by the invention.

A recessed hole (2) permits the mat to be fastened down to the gutter (4) using a lag bolt (3) which is screwed into the concrete gutter (4). Preferably, the recessed hole (2) will have a depth (12) of approximately 2 inches (50 mm), leaving about ¾" (19 mm) thickness of rubber under the head of the lag bolt (3).

Figure 3:
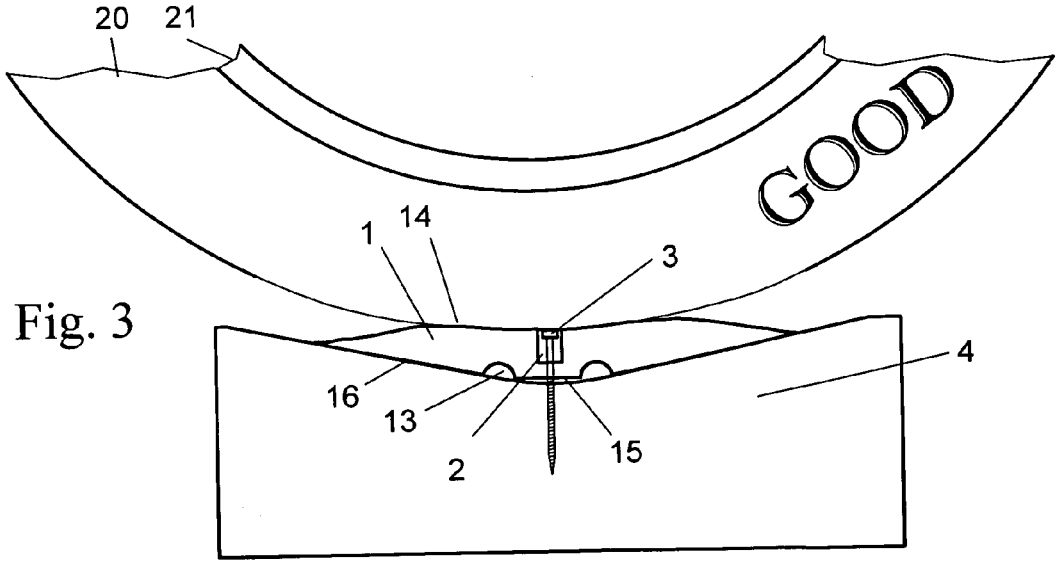
FIG. 3 shows the gutter of FIG. 2, with a tire rolling over the flexible mat.

As is shown in FIG. 3, the body of the gutter mat (1) is flexible, so that it can deform under the weight of a car when a tire (20) on its wheel (21) rolls over the top (14) of the mat (1). The mat (1) can flex until its bottom surface (15) contacts the gutter (16), and the weight of the car is transferred to the ground. The flexing action allows the mat to conform with the gutter, cushioning the passage of the tire (20) over the dip of the gutter. With a hole (2) depth (12) of 2" and a bridging depth (11) of 2", when the mat is flexed so that the bottom of the mat (15) contacts the gutter (16), the bolt (3) will not protrude above the upper surface (14) of the mat (1).

The picture of FIG. 6 shows this deformation and cushioning, as a car (51) rolls over the mat (1) in the gutter (4) from street (5) to driveway (7).

When the car has passed over the mat, its flexible nature permits it to spring back into the bridging position shown in FIG. 2.

As can be seen in FIG. 4, the mat of the invention can be made up of more than one section of speed bump **(1*a*)(1*b*), and end caps (41) can be used to provide a decorative transition at the ends of the assembly, fastened down by lag bolts (not shown) in a hole (42)**.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A driveway gutter comprising:

a rigid gutter form having a length and a width, and a concave trough forming substantially all of an upper surface, running along the length of the form for conveying water along the gutter; and a gutter mat, comprising a flexible body having a domed upper surface and a flat lower surface, and at least one fastening hole penetrating into the body;

the gutter mat being located in the trough such that the lower surface of the body bridges across the trough, creating a gap between the trough an the lower surface for water flow therebetween;

the body of the gutter mat being sufficiently rigid to support the body with its lower surface maintains the gap when unloaded, and being sufficiently flexible to give under a tire of a vehicle, so that the body deforms into the trough and a transition of the tire across the gutter is smoothed.

2. The driveway gutter of claim 1, in which the gutter mat is a pre-fabricated speed bump.

3. The driveway gutter of claim 1, in which the gutter mat comprises a plurality of prefabricated speed bumps aligned along the length of the gutter.

4. The driveway gutter of claim 1, further comprising at least one fastener located in the at least one fastening hole, penetrating into the gutter form, the fastening hole having a depth at least equal to the gap, such that when the fastener is in the fastening hole, and the body is deformed to a point where the lower surface of the body contacts the trough, the fastener does not protrude above the upper surface of the body.

5. The driveway gutter of claim 4, in which the fasteners are lag bolts.

6. A method smoothing a transition across a driveway gutter comprising a rigid gutter form having a length and a width, and a concave trough forming substantially all of an upper surface, running along the length of the form for conveying water along the gutter, comprising the steps of:

placing a gutter mat, comprising a flexible body having a domed upper surface and a flat lower surface, and at least one fastening hole penetrating into the body, into the trough such that the lower surface of the body bridges across the trough, creating a gap between the trough an the lower surface for water flow therebetween;

the body of the gutter mat being sufficiently rigid to support the body with its lower surface maintains the gap when unloaded, and being sufficiently flexible to give under a tire of a vehicle, so that the body deforms into the trough and a transition of the tire across the gutter is smoothed; and fastening the gutter mat to the gutter by driving at least one fastener through the at least one fastening hole, penetrating into the gutter form, the fastening hole having a depth at least equal to the gap, such that when the fastener is in the fastening hole, and the body is deformed to a point where the lower surface of the body contacts the trough, the fastener does not protrude above the upper surface of the body.

* * * * *